US008944277B2

(12) United States Patent
Isenberg et al.

(10) Patent No.: US 8,944,277 B2
(45) Date of Patent: Feb. 3, 2015

(54) FOOD PROCESSING VAT WITH A CLEAN-IN-PLACE VENT

(75) Inventors: Timothy J. Isenberg, Marshfield, WI (US); John E. Zirbel, Marshfield, WI (US)

(73) Assignee: Cheese & Whey Systems, Inc., Marshfield, WI (US)

( * ) Notice: Subject to any disclaimer, the term of this patent is extended or adjusted under 35 U.S.C. 154(b) by 235 days.

(21) Appl. No.: 13/088,978

(22) Filed: Apr. 18, 2011

(65) Prior Publication Data

US 2011/0253730 A1 Oct. 20, 2011

Related U.S. Application Data

(60) Provisional application No. 61/325,612, filed on Apr. 19, 2010.

(51) Int. Cl.

| | |
|---|---|
| ***B65D 90/34*** | (2006.01) |
| ***B08B 9/093*** | (2006.01) |
| ***B01F 7/02*** | (2006.01) |
| ***B01F 7/04*** | (2006.01) |
| ***B08B 9/00*** | (2006.01) |

(52) U.S. Cl.

CPC ..... *B08B 9/093* (2013.01); *B01F 7/022* (2013.01); *B01F 7/042* (2013.01); *B08B 9/00* (2013.01)

USPC ..... 220/745

(58) Field of Classification Search

USPC ..... 220/745, 747, 748, 367.1, 368, 565, 220/913; 99/452, 453, 459; 134/155; 239/103, 120–122

See application file for complete search history.

(56) References Cited

U.S. PATENT DOCUMENTS

| | | | | | |
|---|---|---|---|---|---|
| 662,295 | A | * | 11/1900 | Oltrogge | 220/367.1 |
| 1,465,013 | A | * | 8/1923 | Krause | 215/307 |
| 3,253,435 | A | * | 5/1966 | Berk et al. | 68/181 R |
| 3,374,039 | A | | 3/1968 | Voorhies | |
| 3,403,809 | A | * | 10/1968 | Kennedy et al. | 220/367.1 |
| 3,475,885 | A | * | 11/1969 | Kline | 96/147 |
| 3,625,389 | A | * | 12/1971 | Bartlow | 220/373 |
| 4,059,228 | A | * | 11/1977 | Werner | 239/106 |
| 4,136,886 | A | | 1/1979 | Sjoholm et al. | |
| 4,137,836 | A | * | 2/1979 | Megard | 99/454 |
| 4,511,255 | A | | 4/1985 | Saucier | |
| 4,861,044 | A | | 8/1989 | Jay | |
| 4,938,424 | A | * | 7/1990 | Pittelko | 241/98 |
| 4,989,504 | A | | 2/1991 | Jay | |
| 5,209,028 | A | * | 5/1993 | McDermott et al. | 451/89 |

(Continued)

FOREIGN PATENT DOCUMENTS

| | | |
|---|---|---|
| DE | 2139366 A1 | 2/1973 |
| DE | 2757974 A1 | 6/1979 |

(Continued)

*Primary Examiner* — Fenn Mathew
*Assistant Examiner* — Robert Stodola
(74) *Attorney, Agent, or Firm* — Boyle Fredrickson, S.C.

(57) ABSTRACT

A food processing vat is provided with a vent that can be automatically cleaned in place, without requiring manual cleaning by a technician or removal of the vent from the vat. A nozzle is mounted to at least one of the vent and the vat and has an opening(s) that is posited with respect to the vent to direct cleaning fluid into the vent. The vent may include a canister that concentrically surrounds at least a portion of a vent tube that is fluidly connected to the vat, which collects cleaning fluid and/or condensate from gas that enters or exits the vat.

23 Claims, 4 Drawing Sheets

(56) References Cited

U.S. PATENT DOCUMENTS

| | | | | |
|---|---|---|---|---|
| 5,301,702 | A * | 4/1994 | McKinney | 134/167 R |
| 5,346,093 | A * | 9/1994 | De Benedittis et al. | 220/565 |
| 5,617,609 | A * | 4/1997 | Bently | 15/318 |
| 5,618,107 | A | 4/1997 | Bartsch | |
| 5,753,282 | A | 5/1998 | Tortosa | |
| 5,779,359 | A | 7/1998 | Gambrill et al. | |
| 6,082,889 | A | 7/2000 | Tortosa | |
| 6,168,141 | B1 * | 1/2001 | Zimmer | 261/117 |
| 6,193,409 | B1 | 2/2001 | Brunson et al. | |
| 6,267,048 | B1 * | 7/2001 | Hoogland | 99/454 |
| 6,367,375 | B2 * | 4/2002 | Sipma et al. | 99/466 |
| 6,572,261 | B1 | 6/2003 | Angerhofer et al. | |
| 6,761,191 | B2 | 7/2004 | Rosen et al. | |
| 6,866,414 | B2 | 3/2005 | Kupidlowski | |
| 6,997,601 | B2 | 2/2006 | Feldmeier | |
| 7,325,485 | B2 * | 2/2008 | Carhuff et al. | 99/452 |
| 7,387,431 | B2 | 6/2008 | Blakley | |
| 7,402,023 | B2 | 7/2008 | Kupidlowski | |
| 2005/0193900 | A1 * | 9/2005 | Rosa | 99/452 |
| 2008/0127836 | A1 | 6/2008 | Bokelmann et al. | |
| 2008/0131313 | A1 * | 6/2008 | Bokelmann et al. | 422/28 |
| 2009/0272372 | A1 * | 11/2009 | Griffin et al. | 126/299 E |

FOREIGN PATENT DOCUMENTS

| | | | |
|---|---|---|---|
| DE | 9111033 | U1 | 1/1992 |
| DE | 102004028545 | B3 | 9/2005 |
| FR | 2524265 | A1 | 10/1983 |
| FR | 2587004 | A1 | 3/1987 |
| JP | 2001068402 | A * | 3/2001 |
| NZ | 541574 | | 5/2006 |

* cited by examiner

FOOD PROCESSING VAT WITH A CLEAN-IN-PLACE VENT

CROSS-REFERENCE TO RELATED APPLICATIONS

This application is a continuation of and claims priority from U.S. Provisional Patent Application Ser. No. 61/325,612 filed on Apr. 19, 2010, the entirety of which is expressly incorporated by reference herein.

BACKGROUND OF THE INVENTION

1. Field of the Invention

The invention relates to food processing vats and, more particularly, to vents that are used with food processing vats.

2. Discussion of the Related Art

Vents that are mounted to food processing vats are known in the food processing industries. Such vents fluidly connect an inside space within the vat to the ambient.

Clean-in-place systems for use with food processing vats are also known in the food processing industries. Such clean-in-place systems automatically spray cleaning fluid, in liquid form, inside of food processing vats.

SUMMARY OF THE INVENTION

The inventors have recognized that in typical food processing vats, the clean-in-place systems have been primarily designed to clean the inside walls of the vat and large mechanicals that are housed in the vat, such as agitator shafts, while other parts of the overall vat systems have not been cleaned with these clean-in-place systems. The inventors have also recognized that in typical food processing vats, vents must be manually cleaned by technicians and, at times, require removal of the vents for thorough cleaning, which can be substantially time consuming. The inventors have further recognized that typical vents have side walls with relatively small surface areas upon which to condense out water or other condensate from the vapor or vented fluid that flows out of the vat. The present invention contemplates a vent for a food processing vat that addresses these and other problems and drawbacks of the prior art.

In accordance with an aspect of the invention, a food processing vat system is provided with a vent that is attached to a vat and fluidly connects an inside space of the vat to the ambient so as to maintain a pressure within the vat at an ambient pressure and/or to direct a vented fluid that flows out of the vat to the ambient. A nozzle that is configured to convey a cleaning fluid through it is mounted to at least one of the vent and the vat, and may be mounted in a generally fixed position. The nozzle has an opening that is positioned with respect to the vent so that the nozzle directs the cleaning fluid into the vent while the vent remains attached to the vat. This allows the vent to be cleaned in place, without requiring manual cleaning by a technician.

In accordance with another aspect of the invention, the nozzle is positioned inside of the vent. The vent may define a vent body having an upper edge and the nozzle may be positioned below the upper edge of the vent body. The vent may include a lid, and the vent may further include a nozzle tube that extends through the lid and holds the nozzle inside of the vent. This may also allow the vent to be cleaned in place, without requiring manual cleaning by a technician.

In accordance with another aspect of the invention, the vent defines a vent body and a lid that is positioned with respect to the vent body such that (i) vented fluid that flows out of the vat can flow between the vent body and the lid so that the vented fluid can exit the vent, and (ii) cleaning fluid that is delivered out of the nozzle cannot flow between the vent body and the lid so that the cleaning fluid remains in the vent body or flows into the vat. The lid may include a lid lower portion that longitudinally overlaps at least part of an upper end of the vent body and is transversely spaced from the upper end of the vent body. A lid upper portion may be spaced from the upper end of the vent body. The lid may be maintained by spring clips in such a position with respect to the vent body. This may allow the vented fluid that flows out of the vat to be directed to the ambient while maintaining any cleaning fluid that is sprayed in the vent to remain in the vent or flow into the vat.

In accordance with another aspect of the invention, the vent further includes a collar that is positioned with respect to the nozzle and the lid so that the cleaning fluid that is delivered out of the nozzle is deflected by the collar to prevent the cleaning fluid from exiting the vent. The collar may be connected to and extend downwardly from a lower surface of the lid, spaced radially inside of an outer perimeter of the lid. The vent body may include a tube that is housed concentrically inside of a canister, and the collar may be concentrically aligned between the tube and container. This may allow the collar to deflect cleaning fluid that is delivered from the nozzle so that the cleaning fluid remains in the vent body or flows into the vat, without spraying outside of the vent.

In accordance with another aspect of the invention, the vent is removably attached to the vat. The vent may be attached to the vat with a clamp that holds a pair of flanges that are provided at respective ends of the vent tube, and a vat tube that is fixed to the vat. This may permit quick removal of the vent from the vat for occasional servicing and maintenance.

In accordance with another aspect of the invention, the vent tube extends between the vat or vat tube and the lid of the vent, directing the vented fluid from the vat to the vent. A lower portion of the vent tube may extend beyond the canister and define a solid side wall. An upper portion of the vent tube may be provided within the canister and may have a perforated side wall. The openings or perforations of the perforated side wall may be configured to diffuse streams of the cleaning fluid that is delivered by the nozzle, so that the cleaning fluid is spread out and applied to substantially an entire inner surface(s) area of the vent. This may allow a nozzle to be used near the walls of the vent while delivering cleaning fluid across substantially the entire walls of the vent.

In accordance with another aspect of the invention, the canister extends concentrically around the vent tube so as to define an annular passage between the vent tube and the canister and through which the vented fluid can flow. The canister may further include a lower wall that extends generally radially toward and connects to the vent tube. The lower wall of the canister may connect to the vent tube at a location on the vent tube that generally defines a division line between the solid side wall of the vent tube and the perforated side wall of the vent tube. This may allow the cleaning fluid to be diffused through the perforated side wall of the vent tube, spreading out its application through the vent, while retaining the cleaning fluid within the vent or allowing it to flow into the vat.

According to another aspect of the invention, the canister lower wall is slanted so that different depths of the annular passage are defined at different locations about a periphery of the vent tube. The slanted lower wall may extend angularly with respect to the canister side wall so that corresponding portions of the slanted lower wall, vent tube, and canister side wall define a collection chamber that can collect condensate that condenses out of the vented fluid. The collection chamber may also collect the cleaning fluid that remains in the vent and does not flow into the vat. The vent may include a drain that extends through the canister side wall at a location that corresponds to a deepest portion of the annular passage. This may allow removal of condensate, including water and non-water materials that may be suspended in the vented fluid, the cleaning fluid, and/or other substances that may collect in the collection chamber to be removed from the vent.

Various other features, objects, and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
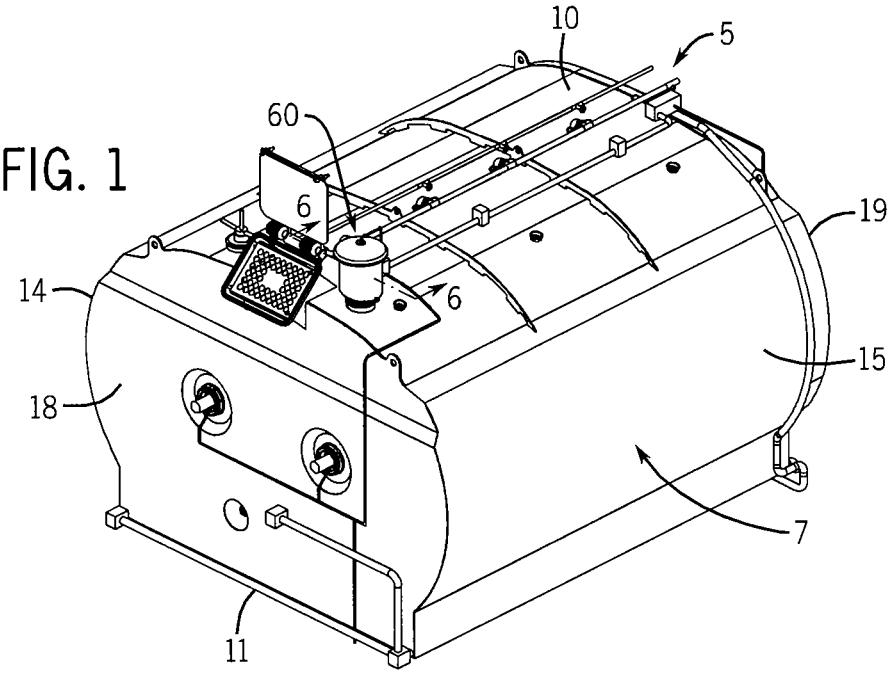
FIG. 1 is an isometric view from above and in front of a vat system incorporating a clean-in-place vent in accordance with the present invention.
Figure 2:
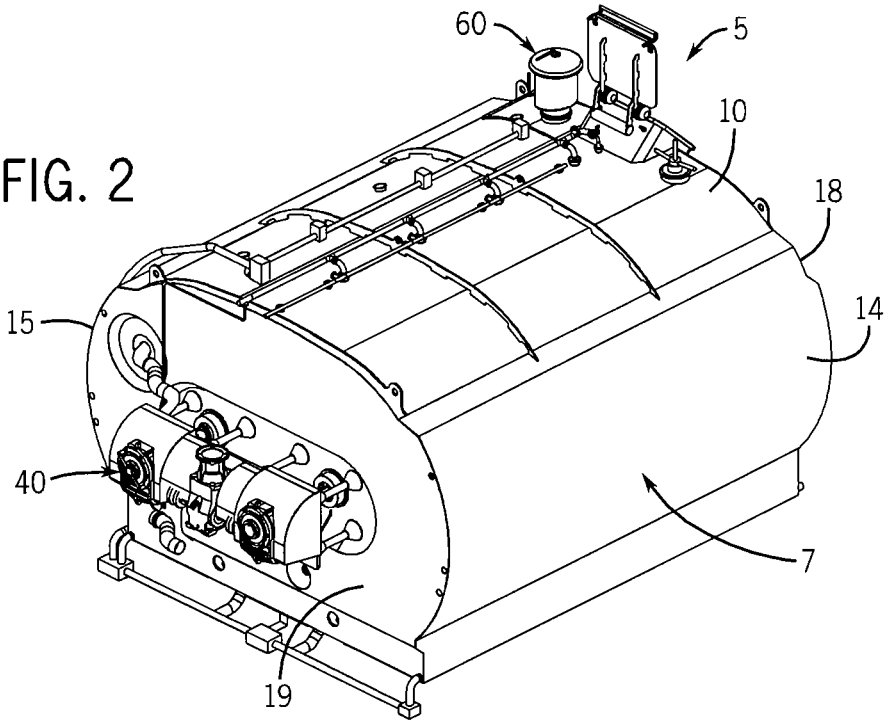
FIG. 2 is an isometric view from above and in back of the vat system of FIG. 1.
Figure 3:
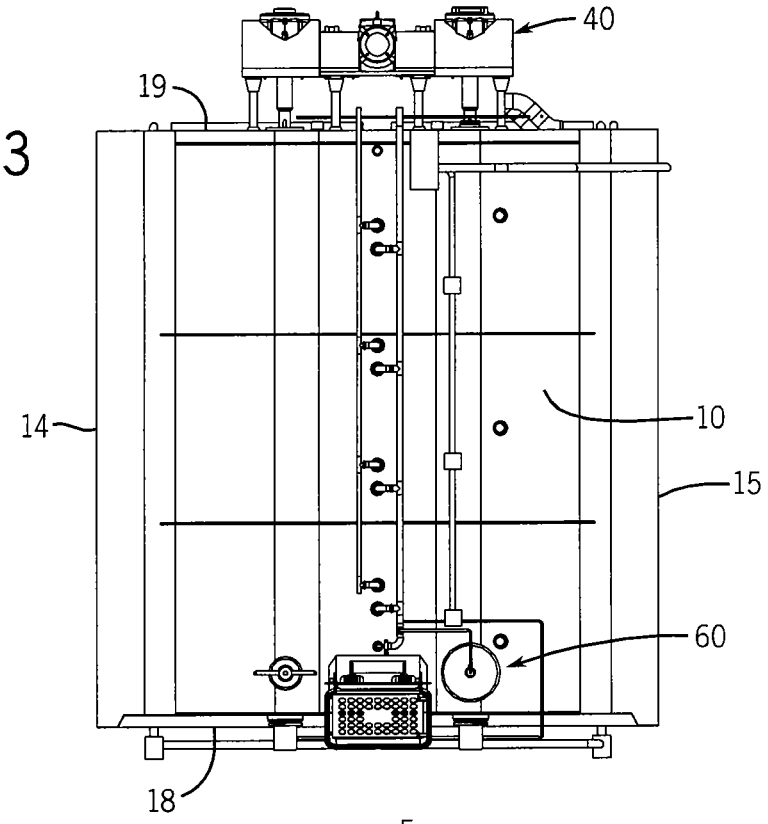
FIG. 3 is a top plan view of the vat system of FIG. 1.
Figure 4:
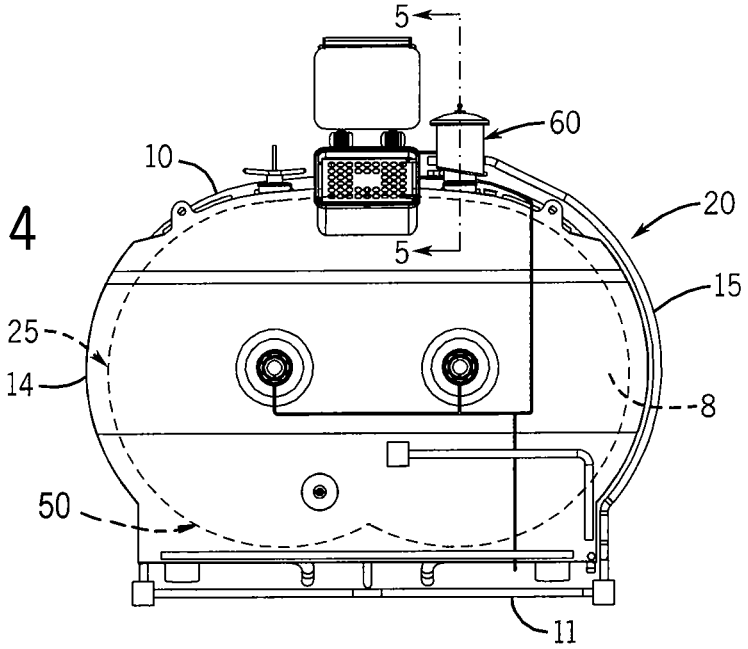
FIG. 4 is a front elevation view of the vat system of FIG. 1.

FIGS. 1 and 2 illustrate a vat system 5 that can be used for processing food and related products (collectively referred to as "vat contents") by mechanically manipulating and heating or cooling the vat contents, depending on the particular food or related product being processed. In a representative application, the vat system 5 may be used in the production of cheese, although it is understood that the vat system 5 may be used in processing other types of food products. The vat system 5 includes a vat 7 that has an agitation system 40 which performs the mechanical manipulation tasks by rotating a pair of shafts upon which blade assemblies are mounted, and a zoned heat transfer system 50 to perform heating and/or cooling to provide zoned temperature control to the vat 7.

Vat 7 defines an enclosure having a top wall 10, a bottom wall 11, and side walls 14, 15, all of which extend longitudinally between a pair of end walls 18 and 19. The walls 10, 11, 14, 15, 18, 19 are multilayered, having an outer jacket 20 and an inner shell 25 that are spaced from each other. Insulation and various components of the zoned heat transfer system 50 are housed between the jacket 20 and shell 25. The shell 25 is the innermost structure of the vat 7, so that its inner surface surrounds and defines an outer periphery of a void or inside space 8 within the vat 7. A lower part of the inside space 8 resembles two horizontal parallel cylinders that transversely intersect each other, being defined by a lower portion of the shell 25 that has a pair of arcuate depressions which extend along the length of the vat 7, on opposing sides of a longitudinally extending raised middle segment. From the lower portion of the shell 25, opposing side portions extend in an outwardly bowed manner, arching away from each other in a transverse direction of the vat 7. An upper portion of the shell 25 arcs gradually between side portions of the shell 25 and defines an upper perimeter of the inside space 8 of vat 7.

Referring now to FIGS. 1-4, operation of the zoned heat transfer system 50 alters the temperature of the inside space 8 of vat 7, which correspondingly changes a volume of the gases within the inside space 8 of vat 7. Vent 60 allows the vat 7 to breathe, accommodating the changing volume of gases without changing a pressure within the vat 7 so as to keep the pressure of the inside space 8 of the vat at the ambient pressure.

Figure 5:
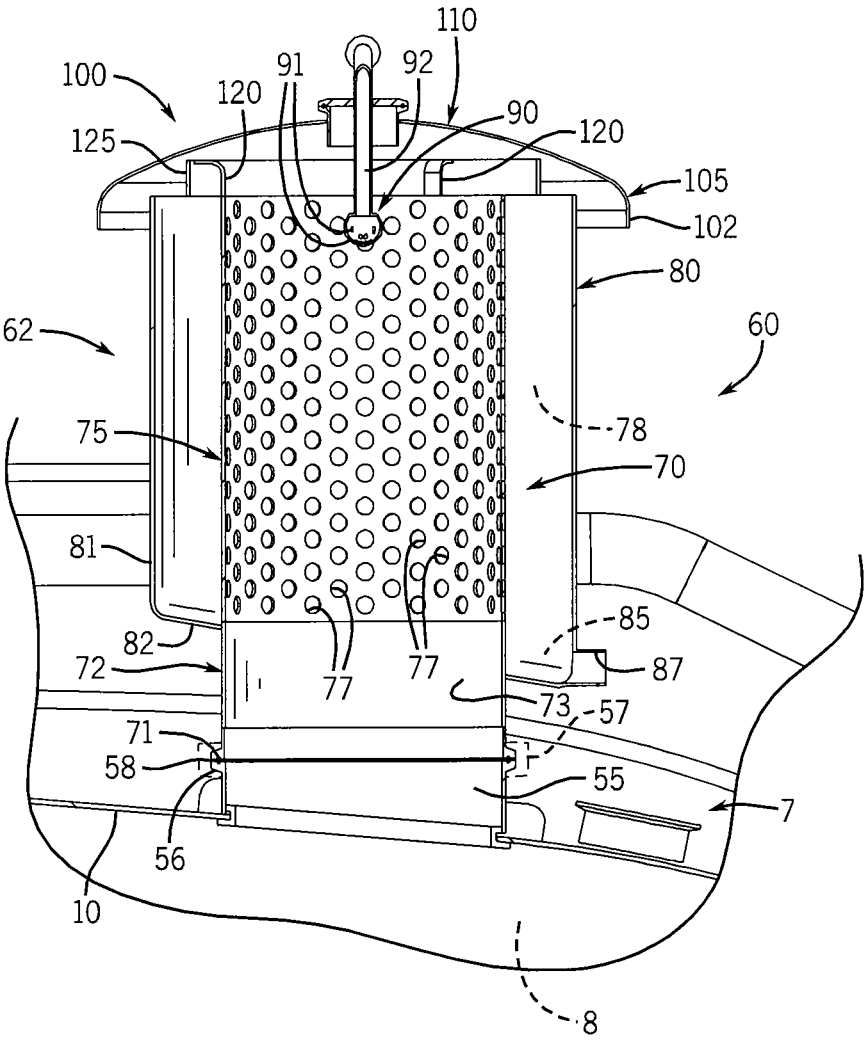
FIG. 5 is a sectional view of the vent of the vat system of FIG. 1, taken at line 5-5 of FIG. 4.
Figure 6:
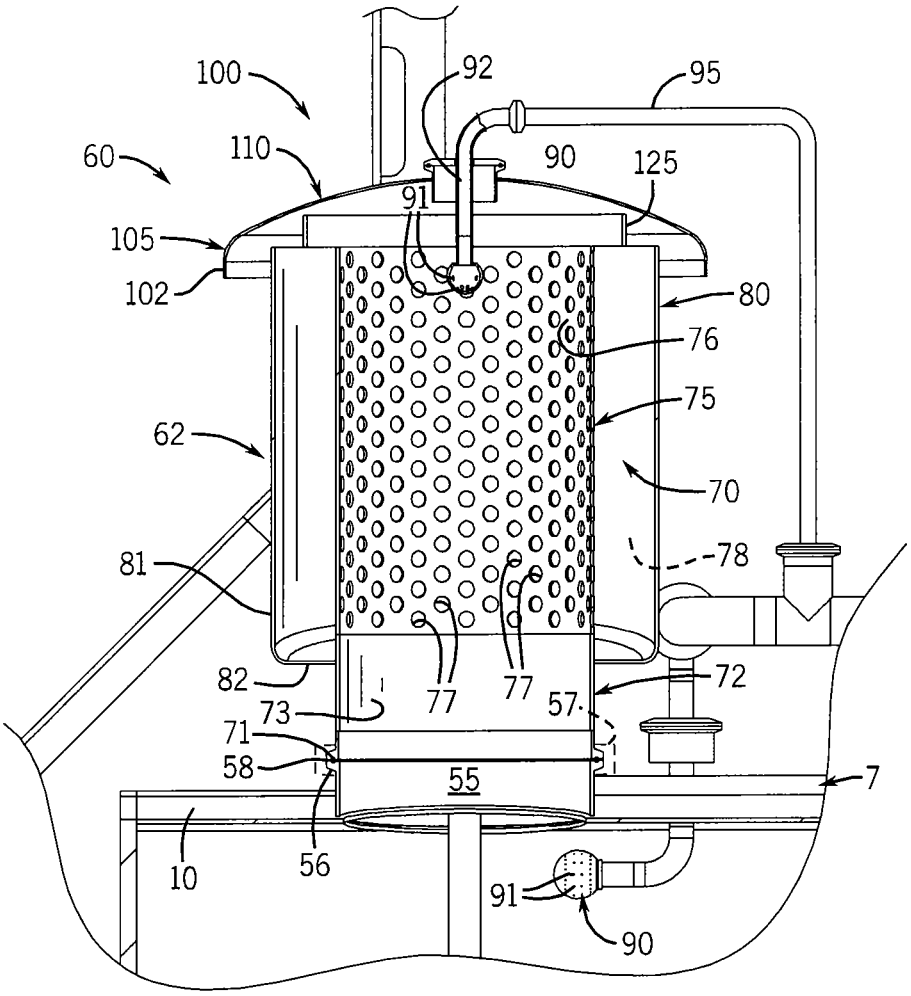
FIG. 6 is a sectional view of the vent of the vat system of FIG. 1, taken at line 6-6 of FIG. 1.

Referring now to FIGS. 5 and 6, vent 60 includes a vent body 62 that is defined by a vent tube 70 and a container or canister 80, and a lid 100 that sits over the vent body 62. A nozzle 90 that sprays a cleaning fluid, which may be in a liquid form, is positioned with respect to the vent tube 70, canister 80, and lid 100 so that the cleaning fluid that exits the nozzle 90 either remains in the vent 60 or flows into the vat 7, described in greater detail elsewhere herein.

Still referring to FIGS. 5 and 6, in this embodiment, the vent 60 is attached to the vat 7 by coupling the vent tube 70 to a vat tube 55. Vat tube 55 is connected at its bottom end to the top wall 10 of the vat 7. A flange 56 is connected to the top end of the vat tube 55. Flange 56 sits below a cooperating flange 71 that is connected to the bottom of vent tube 70, and a seal 58 sits between the flanges 56, 71 of the vat and vent tubes 55, 70, respectively. A lower surface of flange 56 and an upper surface of flange 71 are angled toward each other. Correspondingly, a cross-sectional profile shape of the flanges 56, 71 together is wedge-shaped, tapering down from a thicker portion adjacent the vat and vent tubes 55, 70, respectively, to a thinner portion that is radially furthest from the vat and vent tubes 55, 70, respectively. A clamp 57 (FIG. 5) fits around and engages both of the flanges 56, 71 and pushes them toward each other to compress the seal 58 to provide a liquid-tight joint between the vat and vent tubes 55, 70, respectively. Removal of the clamp 57 from the flanges 56, 71 allows the vent 60 to be detached from the vat 7 by lifting the vent away from the vat tube 55.

Still referring to FIGS. 5 and 6, in this embodiment, a lower portion 72 of the vent tube 70 extends upwardly from the flange 71, toward the canister 80. Lower portion 72 has a solid side wall 73 which ensures that the vented fluid flows in a generally longitudinal direction through the lower portion 72, without escaping the confines of the lower portion 72 of the vent tube 70.

An upper portion 75 of the vent tube 70 connects to and extends upwardly from the lower portion 72. The upper portion 75 in this embodiment has a length that is over half of the overall length of the vent tube 70, the upper portion 75 being about four times longer than the lower portion 72. In another embodiment, the upper portion 75 may be about two times longer than the lower portion 72. A side wall 76 of upper portion 75 is perforated with openings 77 that extend entirely through the thickness of the side wall 76 and that are spaced at substantially equal distances from each other to provide a matrix or array of openings 77 that define the perforation(s).

The perforated side wall 76 of the upper portion 75 of the vent tube 70 allows the vented fluid that flows out of the lower portion 72 to flow in both a generally longitudinal direction through the upper portion 75 and also in a generally radial direction out of the openings 77. In so doing, a portion of the vented fluid flows through the entire length of the upper portion 75 and exits out of the vent tube 70 through an opening defined at an upper perimeter edge of the upper portion 75 with its further longitudinal flow being impeded by the overlying lid 100. The rest of the vented fluid diffuses and radially flows through the openings 77 of the perforated side wall, with its further radially directed flow being impeded by the canister 80.

Still referring to FIGS. 5 and 6, canister 80 includes a solid side wall 81 that extends concentrically around the vent tube 70, so as to define an annular passage 78 between the vent tube 70 and the canister 80. The annular passage 78 provides a path through which the vented fluid flows in a longitudinal direction while exiting the vent 60, after flowing in the radial direction into the annular passage 78 from the vent tube 70. A diameter of the flow path through the vent 60 which is defined by the solid side wall segments that radially restrict flow through the vent 60, namely, the side walls 73 and 81, has a step-change increase in which the relatively smaller diameter of the side wall 73 of the vent tube lower portion 72 increases to a relatively larger diameter of the side wall 81 of the canister 80. Such diameter increase occurs generally at a lower wall 82 of the canister 80.

Lower wall 82 of the canister 80 has an annular perimeter shape and extends radially between the vent tube 70 and canister side wall 81. Lower wall 82 connects the canister side wall 81 to the vent tube 70 at a location that generally defines a division line between the solid and perforated side walls 73, 76, respectively, of the upper and lower portions 72, 75, respectively, of the vent tube 70.

In this embodiment, the canister lower wall 82 is slanted, extending angularly with respect to the tube and canister side walls 73, 76, 81. This provides the annular passage 78 with different depths at different locations about the perimeter of the vent tube 70. A collection chamber 85 is defined by a space between respective portions of the slanted lower wall 82, vent tube 70, and canister side wall 81 that can collect condensate that condenses out of the vented fluid and/or cleaning fluid that is delivered out of nozzle 90.

The particular volume of condensate, cleaning fluid, or other liquid that the collection chamber 85 holds is determined at least in part by (i) the width of the lower wall 82 and thus the radial distance between the vent tube 70 and canister 80, and (ii) the particular location of the division line between the solid and perforated side walls 73, 76, respectively, of the upper and lower portions 72, 75, respectively, of the vent tube 70 and thus a maximum height at which contents in the collection chamber 85 can be held and over which the contents will spill through the openings 77 of the perforated side wall 76 and run down the inside of vent tube 70 and into the vat 7. In this embodiment, the diameter of the canister 80 is about 25 percent larger than the diameter of the vent tube 70, although it is understood that any other satisfactory differential may be employed. Also in this embodiment, the division line between the solid and perforated side walls 73, 76, respectively, of the upper and lower portions 72, 75, respectively, of the vent tube 70 extends orthogonally with respect to a longitudinal axis of the vent tube 70, whereby the division line is not slanted like the orientation of the canister lower wall 82. In another embodiment, the division line between the solid and perforated side walls 73, 76, respectively, of the upper and lower portions 72, 75, respectively, of the vent tube 70 may extend parallel to the canister lower wall 82.

Still referring to FIGS. 5 and 6, regardless of the particular location of the division line between the solid and perforated side walls 73, 76, respectively, of the upper and lower portions 72, 75, respectively, of the vent tube 70, the collection chamber 85 includes a drain 87 that extends though the canister side wall 81. The drain 87 of this embodiment is provided at a location upon the canister side wall 81 that corresponds to a deepest portion of the annular passage 78 and thus at the bottom of the collection chamber 85. The drain 87 allows removal of condensate, including liquid and non-liquid materials that may be suspended in the vented fluid, the cleaning fluid, and/or other substances that may collect in the collection chamber 85, to be removed from the vent 60. Still referring to FIGS. 5 and 6, the cleaning fluid that may collect in the collection chamber 85 is that which is delivered from nozzle 90 during a clean-in-place procedure. Nozzle 90 is positioned with respect to the vat system 5 so that its opening(s) 91 directs cleaning fluid into the vent 60 while the vent remains attached to the vat 7. FIG. 6 shows another nozzle 90 that is mounted to the top wall 10 of the vat and has openings 91 provided about its outer surface so as to direct cleaning fluid in multiple directions, so that some of the cleaning fluid may enter the bottom opening of the vat tube 55 and may deflect into the vent 60.

Still referring to FIGS. 5 and 6, in this embodiment, toward the top of the vent 60, one of the nozzles 90 that can spray cleaning fluid is mounted fully inside of the vent 60. This nozzle 90 is positioned below an upper edge of the vent body 62 and is substantially aligned with a longitudinal axis of the vent 60 and thus concentrically inside of the perforated side wall 76 of the upper portion 75 of vent tube 70. With the nozzle 90 mounted in this position with respect to the perforated side wall 76, the discrete streams of cleaning fluid leaving the openings 91 can be split into more streams that deflect in different directions while being sprayed through the openings 77 of the perforated side wall 76, diffusing the cleaning fluid and spreading out its application through the vent 60.

Referring now to FIG. 6, in this embodiment, the nozzle 90 is mounted to and suspended from the lid 100 with a nozzle tube 92. The nozzle tube 92 extends through a flange that is raised above the rest of the lid 100 with a tube segment that extends above and below the lid 100. An end of the nozzle tube 92 that is outside of the vent 60 has a flange that couples to a corresponding flange of a cleaning fluid supply line 95, allowing such flanges to be uncoupled from each other to separate the nozzle tube 92 from the cleaning fluid supply line 95 while leaving the nozzle tube 92 connected to the lid 100. The cleaning fluid supply line 95 is connected to a known clean-in-place system (including suitable plumbing components, hardware components, and controls) that is configured to deliver cleaning fluid for automatically spraying down predetermined surfaces within the vat system 5.

Referring again to FIGS. 5 and 6, the lid 100 is dished out, presenting a convex upper surface and a concave lower surface, with a lower lip 102 provided at a lower portion 105 of the lid 100 and extending downwardly from its outer perimeter. The lid 100 is positioned with respect to the vent body 62 such that (i) vented fluid that flows out of the vat 7 can flow between the vent body 62 and the lid 100 so that the vented fluid can exit the vent 60, and (ii) cleaning fluid that is delivered out of the nozzle 90 cannot flow between the vent body 62 and the lid 100 so that the cleaning fluid remains in the vent body 62 or flows into the vat 7. The lip 102 of the lower portion 105 longitudinally overlaps at least part of an upper end of the vent body 62 and is transversely spaced from the upper end of the vent body 62. A lid upper portion 110 is spaced longitudinally from the upper end of the vent body 62.

The lid 100 of this embodiment is maintained in this overlying and longitudinally and radially-spaced relationship with respect to the vent body 62 by spring clips 120. In this embodiment, the spring clips 120 are connected to and extend upwardly from an upper edge of the vent tube 70. Spring clips 120 are bent and generally L-shaped and have an upright segment that aligns with the vent tube 70 and a horizontal segment that engages an inner circumferential surface of a collar 125.

Still referring to FIGS. 5 and 6, collar 125 is connected to and extends down from a lower surface of the lid 100 and is spaced radially inside of an outer perimeter of the lid 100. The collar 125 is positioned concentrically between the vent tube 70 and canister 80 when viewed from a top plan view. In this embodiment, the collar 125 extends downwardly from the lid 100 to a height along the vent 60 at which upper edges of the vent tube 70 and canister 80 are provided. In another embodiment, the collar 125 extends relatively further down, between the vent tube 70 and canister 80, and thus into the annular passage 78. Regardless of how far the collar 125 extends from the lid 100 in any particular embodiment, the collar 125 is positioned with respect to the nozzle 90 and the lid 100 so that some of the cleaning fluid that is delivered out of the nozzle 90 is deflected by the collar 125 into the annular passage 78, preventing such cleaning fluid from exiting the vent 60. The collar 125 thus cooperates with the upper end of vent tube 70 and the upper end of canister 80 to define a serpentine path between the interior of the vent tube 70 and the exterior of canister 80, which allows passage of air into and out of vat 7 and also functions to ensure that cleaning fluid from nozzle 90 does not escape from vent 60 other than through collection chamber 85 at the lower end of annular passage 78.

Various alternatives and embodiments are contemplated as being within the scope of the following claims particularly pointing out and distinctly claiming the subject matter regarded as the invention.

We claim:

1. A food processing vat system comprising:

a vat having wall structure defining an inside space therein;

a vent fluidly connecting the inside space of the vat to the ambient so as to maintain a pressure within the vat at an ambient pressure, the vent defining a collection chamber having a lower wall spaced from the wall structure of the vat and including a drain arranged with respect to the lower wall of the collection chamber for removing the entire collected contents of the collection chamber; and a nozzle being configured to convey a cleaning fluid therethrough and mounted to at least one of the vent and the vat, the nozzle having an opening that is positioned with respect to the vent so as to direct the cleaning fluid into the vent, wherein at least some of the cleaning fluid collects in the collection chamber as collected contents and is entirely removed from the collection chamber through the drain while the vent remains attached to the vat.

2. The food processing vat system of claim 1, wherein the nozzle is positioned inside of the vent.

3. The food processing vat system of claim 2, the vent defining a body thereof and further comprising a lid that is positioned with respect to the vent body such that (i) vented fluid that flows out of the vat can flow between the vent body and the lid so that the vented fluid can exit the vent, and (ii) cleaning fluid that is delivered out of the nozzle cannot flow between the vent body and the lid so that the cleaning fluid remains in the vent body or flows into the vat.

4. The food processing vat system of claim 3 wherein he nozzle is positioned below an upper edge of the vent body.

5. The food processing vat system of claim 3, the vent further comprising a nozzle tube that extends through the lid and holds the nozzle inside of the vent.

6. The food processing vat system of claim 3, wherein the lid includes (i) a lid lower portion that overlaps at least part of an upper end of the vent body, and (ii) a lid upper portion that is spaced from the upper end of the vent body.

7. The food processing vat system of claim 6, wherein the lid lower portion (i) longitudinally overlaps at least part of the upper end of the vent body, and (ii) is transversely spaced from the upper end of the vent body.

8. The food processing vat system of claim 3, the vent body further comprising a tube that extends between the vat and the lid of the vent and directs the vented fluid from the vat to the vent.

9. The food processing vat system of claim 8, the vent body further comprising a canister around the tube so as to define an annular passage between the tube and the canister and through which the vented fluid can flow.

10. The food processing vat system of claim 9, the canister having a side wall and wherein the lower wall of the vent defines a slanted lower wall that extends angularly with respect to the canister side wall such that corresponding portions of the slanted lower wall, tube, and canister side wall define the collection chamber, wherein the vat wall structure includes an upper wall and wherein the slanted lower wail of the canister is spaced from the upper wall of the vat.

11. The food processing vat system of claim 10, wherein the drain extends through the canister side wall and into the collection chamber for removing condensate from the vent.

12. The food processing vat system of claim 11, wherein the condensate includes water and non-water materials that were suspended in the vented fluid.

13. A food processing vat system comprising:

a vat defining an inside space therein;

a vent attached to the vat and fluidly connecting the inside space of the vat o the ambient so as to maintain a pressure within the vat at an ambient pressure; and a nozzle being configured to convey a cleaning fluid therethrough and mounted to at least one of the vent and the vat, the nozzle having an opening that is positioned with respect to the vent so as to direct the cleaning fluid into the vent while the vent remains attached to the vat, wherein the nozzle is positioned inside of the vent;

the vent defining a body thereof and further comprising a lid that is positioned with respect to the vent body such that (i) vented fluid that flows out of the vat can flow between the vent body and the lid so that the vented fluid can exit the vent, and (ii) cleaning fluid that is delivered out of the nozzle cannot flow between the vent body and the lid so that the cleaning fluid remains in the vent body or flows into the vat, the vent body further comprising a tube that extends between the vat and the lid of the vent and directs the vented fluid from the vat to the vent, and the vent body further comprising a canister around the tube so as to define an annular passage between the tube and the canister and through which the vented fluid can flow; and wherein a lower portion of the tube extends beyond the canister and has a solid side wall and a portion of the tube that is provided within the canister has a perforated side wall.

14. The food processing vat system of claim 13, the canister further comprising a lower wall that extends generally radially toward and connects to the tube.

15. The food processing vat system of claim 14, wherein the canister lower wall connects to the tube at a location on the tube that generally defines a division line between the solid side wall of the tube and the perforated side wall of the tube.

16. The food processing vat system of claim 14, wherein the canister lower wall is slanted so that different depths of the annular passage are defined at different locations about a periphery of the tube.

17. The food processing vat system of claim 16, the vent further comprising a drain that extends through the canister side wall at a location that corresponds to a deepest portion of the annular passage.

18. A food processing vat system comprising:

a vat having wall structure defining an inside space therein;

a vent fluidly connecting the inside space of the vat to the ambient so as to maintain a pressure within the vat to an ambient pressure and to direct vented fluid that flows out of the vat to the ambient, the vent defining a collection chamber having a lower wall spaced from the wall structure of the vat and including a drain arranged for removing the entire collected contents of the collection chamber; and a nozzle that is arranged to deliver cleaning fluid inside of the vent, wherein at least some of the cleaning fluid collects in the collection chamber as collected contents that is entirely removed through the drain while the vent remains attached to the vat.

19. The food processing vat system of claim 18, wherein the vent includes a vent body having a tube and a container that surrounds at least a portion of the tube.

20. The food processing vat system of claim 19, the vent further comprising a collar between the tube and container, and being configured to deflect cleaning fluid that is delivered from the nozzle such that the cleaning fluid remains in the vent body or flows into the vat and does not exit the vent.

21. A food processing vat system comprising:

a vat having wall structure defining an inside space therein;

a vent fluidly connecting the inside space of the vat to the ambient so as to maintain a pressure within the vat at an ambient pressure and to direct vented fluid that flows out of the vat to the ambient, wherein the vent defines a collection chamber that can collect contents therein and is spaced from the wall structure, the vent including a solid side wall and a perforated side wall arranged inwardly of the solid side wall and a drain arrange with respect to the solid side wall for removing the entire collected contents of the collection chamber; and a nozzle that is mounted in a generally fixed position and delivers cleaning fluid inside of the vent, wherein the cleaning fluid is directed through the perforated side wall and toward the solid side wall such that some of the cleaning fluid flows from the vent into the inside space of the vat and the remainder of the cleaning fluid collects as the collected contents of the collection chamber and wherein the entire collected contends of the collection chamber is removed through the drain.

22. The food processing vat system of claim 21, wherein the vent includes a bottom wall that extends generally radially between the perforated and solid side walls and wherein the perforated and solid side walls extend generally parallel to each other.

23. The food processing vat system of claim 22, wherein the bottom wall of the vent is arranged at an angle with respect to the perforated and solid side walls.

* * * * *

UNITED STATES PATENT AND TRADEMARK OFFICE

CERTIFICATE OF CORRECTION

PATENT NO. : 8,944,277 B2
APPLICATION NO. : 13/088978
DATED : February 3, 2015
INVENTOR(S) : Isenberg et al.

It is certified that error appears in the above-identified patent and that said Letters Patent is hereby corrected as shown below:

IN THE CLAIMS

Column 7, line 55, Claim 4, after “3”, insert -- , --;

Column 7, line 55, Claim 4, delete “he” and substitute therefore -- the --;

Column 8, line 55, Claim 10, delete “wail” and substitute therefore -- wall --;

Column 8, line 26, Claim 13, delete “o” and substitute therefore -- to --;

Column 10, line 6, Claim 21, delete “arrange” and substitute therefore -- arranged --;

Column 10, line 16, Claim 21, delete “contends” and substitute therefore -- contents --.

Signed and Sealed this
Fifth Day of May, 2015

Michelle K. Lee

Michelle K. Lee
*Director of the United States Patent and Trademark Office*